US008939234B2

(12) United States Patent
Mebane, III et al.

(10) Patent No.: US 8,939,234 B2
(45) Date of Patent: Jan. 27, 2015

(54) SYSTEMS AND METHODS FOR IMPROVING DRILLING EFFICIENCY

(75) Inventors: Robert Eugene Mebane, III, Austin, TX (US); Frederick Ray Florence, Austin, TX (US)

(73) Assignee: National Oilwell Varco, L.P., Houston, TX (US)

( * ) Notice: Subject to any disclaimer, the term of this patent is extended or adjusted under 35 U.S.C. 154(b) by 275 days.

(21) Appl. No.: 13/497,490

(22) PCT Filed: Sep. 21, 2010

(86) PCT No.: PCT/US2010/049575

§ 371 (c)(1), (2), (4) Date: May 7, 2012

(87) PCT Pub. No.: WO2011/035280

PCT Pub. Date: Mar. 24, 2011

(65) Prior Publication Data

US 2012/0217067 A1 Aug. 30, 2012

Related U.S. Application Data

(60) Provisional application No. 61/244,335, filed on Sep. 21, 2009.

(51) Int. Cl.

| | |
|---|---|
| ***E21B 7/24*** | (2006.01) |
| ***E21B 7/00*** | (2006.01) |
| ***E21B 44/02*** | (2006.01) |

(52) U.S. Cl.

CPC ..... *E21B 44/02* (2013.01)
USPC ..... 175/57; 175/61; 175/62; 175/424

(58) Field of Classification Search

USPC ..... 175/57, 61, 62, 424
See application file for complete search history.

(56) References Cited

U.S. PATENT DOCUMENTS 3,658,138 A * 4/1972 Gosselin ..... 173/1
3,872,932 A * 3/1975 Gosselin ..... 173/1

(Continued)

FOREIGN PATENT DOCUMENTS

EP 0443689 A3 8/1991
EP 0870899 A1 10/1998

(Continued)

OTHER PUBLICATIONS

Dictionary definition of "oscillate", accessed Mar. 12, 2014 via thefreedictionary.com.*

(Continued)

*Primary Examiner* — Blake Michener
(74) *Attorney, Agent, or Firm* — Conley Rose, P.C.

(57) ABSTRACT

A method for drilling a borehole in an earthen formation comprises (a) providing a drilling system including a drillstring having a longitudinal axis, a bottom-hole assembly coupled to a lower end of the drillstring, and a drill bit coupled to a lower end of the bottom-hole assembly. In addition, the method comprises (b) rotating the drill bit at a rotational speed. Further, the method comprises (c) applying weight-on-bit to the drill bit and advancing the drill bit through the formation to form the borehole. Still further, the method comprises (d) pumping a drilling fluid down the drillstring to the drill bit. The drilling fluid has a flow rate down the drillstring. Moreover, the method comprises (e) oscillating the rotational speed of the drill bit during (c). The method also comprises (f) generating non-steady state conditions in the borehole during (e).

15 Claims, 6 Drawing Sheets

(56) References Cited

U.S. PATENT DOCUMENTS

| | | | | |
|---|---|---|---|---|
| 4,261,425 | A * | 4/1981 | Bodine | 175/106 |
| 4,763,258 | A * | 8/1988 | Engelder | 340/853.3 |
| 4,854,397 | A * | 8/1989 | Warren et al. | 175/26 |
| 4,995,465 | A * | 2/1991 | Beck et al. | 175/27 |
| 5,117,926 | A | 6/1992 | Worrall et al. | |
| 5,259,468 | A * | 11/1993 | Warren et al. | 175/45 |
| 5,454,436 | A * | 10/1995 | Jardine et al. | 175/40 |
| 6,166,654 | A | 12/2000 | Van Den Steen | |
| 6,267,185 | B1 * | 7/2001 | Mougel et al. | 175/57 |
| 6,327,538 | B1 | 12/2001 | Chin | |
| 6,338,390 | B1 * | 1/2002 | Tibbitts | 175/56 |
| 6,802,378 | B2 * | 10/2004 | Haci et al. | 175/26 |
| 6,847,304 | B1 * | 1/2005 | McLoughlin | 340/854.3 |
| 7,036,612 | B1 * | 5/2006 | Raymond et al. | 175/321 |
| 7,152,696 | B2 * | 12/2006 | Jones | 175/61 |
| 7,222,681 | B2 * | 5/2007 | Jones et al. | 175/38 |
| 7,245,229 | B2 * | 7/2007 | Baron et al. | 340/853.3 |
| 7,341,116 | B2 * | 3/2008 | Fincher et al. | 175/57 |
| 7,461,705 | B2 | 12/2008 | Hulick et al. | |
| 7,540,337 | B2 * | 6/2009 | McLoughlin et al. | 175/45 |
| 7,588,100 | B2 * | 9/2009 | Hamilton | 175/61 |
| 7,730,943 | B2 * | 6/2010 | Farley | 166/250.01 |
| 7,983,113 | B2 * | 7/2011 | Krueger et al. | 367/83 |
| 2002/0157871 | A1 | 10/2002 | Tulloch | |
| 2005/0001737 | A1 * | 1/2005 | Baron et al. | 340/854.4 |
| 2006/0185900 | A1 * | 8/2006 | Jones et al. | 175/26 |
| 2006/0195265 | A1 | 8/2006 | Schen et al. | |
| 2007/0295537 | A1 | 12/2007 | Fincher et al. | |
| 2008/0066958 | A1 * | 3/2008 | Haci et al. | 175/27 |
| 2008/0156531 | A1 * | 7/2008 | Boone et al. | 175/27 |
| 2009/0044977 | A1 * | 2/2009 | Johnson et al. | 175/24 |
| 2009/0057018 | A1 * | 3/2009 | Farley | 175/73 |
| 2009/0065258 | A1 * | 3/2009 | Hamilton | 175/61 |
| 2009/0090555 | A1 * | 4/2009 | Boone et al. | 175/45 |
| 2009/0114445 | A1 | 5/2009 | Dashevskiy | |

FOREIGN PATENT DOCUMENTS

| | | | |
|---|---|---|---|
| EP | 1114240 | B1 | 8/2005 |
| WO | 2010063982 | A1 | 6/2010 |
| WO | 2010064031 | A1 | 6/2010 |

OTHER PUBLICATIONS

International Application No. PCT/US2010/049575 Search Report and Written Opinion dated May 19, 2011.

J. D. Jansen et al; "Active Damping of Self-Excited Torsional Vibrations in Oil Well Drillstrings"; Journal of Sound Vibration; vol. 179, No. 4; 1995; pp. 647-668.

G. W. Halsey et al; "Torque Feedback Used to Cure Slip-Stick Motion"; 63rd Annual Technical Conference; Oct. 2-5, 1989; SPE 18049; Society of Petroleum Engineers; Houston, Texas, U.S.A.

D. R. Pavone et al; "Application of High Sampling Rate Downhole Measurements for Analysis and Cure of Stick-Slip in Drilling"; SPE 28324; Society of Petroleum Engineers.

P. J. Perreau; "New Results in Real Time Vibrations Prediction"; SPE 49479; Society of Petroleum Engineers.

Canadian Office Action Dated Jul. 10, 2013; Canadian Application No. 2,774,551 (3 p.).

Canadian Office Action dated Apr. 10, 2014; Canadian Application No. 2,774,551 (3 p.).

* cited by examiner

SYSTEMS AND METHODS FOR IMPROVING DRILLING EFFICIENCY

CROSS-REFERENCE TO RELATED APPLICATIONS

This application claims benefit of U.S. provisional patent application Ser. No. 61/244,335 filed Sep. 21, 2009, and entitled "Systems and Methods for Improving Drilling Efficiency," which is hereby incorporated herein by reference in its entirety.

STATEMENT REGARDING FEDERALLY SPONSORED RESEARCH OR DEVELOPMENT

Not applicable.

BACKGROUND

1. Field of the Invention

The disclosure relates generally to methods and systems for drilling boreholes for the ultimate recovery of oil, gas or minerals. More particularly, the disclosure relates to methods and systems for avoiding, disrupting, and/or preemptively preventing undesirable "steady state" conditions and harmonic motions during drilling operations.

2. Background of the Technology

To obtain hydrocarbons such as oil and gas, boreholes are drilled by rotating a drill bit attached to a drillstring. The drill bit is typically mounted on the lower end of the drillstring as part of a bottomhole assembly (BHA) and is rotated by rotating the drillstring at the surface or by actuation of downhole motors or turbines, or by both methods. With weight applied to the drillstring, the rotating drill bit engages the earthen formation and proceeds to form a borehole along a path toward a target zone.

To aid in the removal of drilling cuttings from the bottom of the borehole, pressurized drilling fluid (commonly know as "mud" or "drilling fluid") is pumped down the drillstring to the drill bit mounted at the lower end of the bottomhole assembly. The drilling fluid exits the drill bit through nozzles or jet assemblies positioned in bores formed in the body of the bit. To efficiently remove cuttings from the borehole, the drilling fluid must carry the cuttings radially outward on the borehole bottom, and then upward through the annulus between the drillstring and the borehole wall. As the drilling fluid flows past the cutting structure, the fluid impacts the borehole bottom and spreads radially outward to the annulus. In general, as the efficiency of the cutting removal is increased, the cutting efficiency and associated rate-of-penetration (ROP) of the drill bit are also increased.

A number of downhole devices placed in close proximity to the drill bit measure certain downhole parameters associated with the drilling and downhole conditions. Such devices typically include sensors for measuring downhole temperatures and pressures, azimuth and inclination measuring devices, and a resistivity-measuring device to determine the presence of hydrocarbons and water. Additional downhole instruments, known as logging-while-drilling ("LWD") and/or measurement-while drilling ("MWD") tools, are frequently attached to the drillstring to determine the formation geology and formation fluid conditions during the drilling operations. The information provided to the operator during drilling usually includes drilling parameters, such as weight-on-bit (WOB), rotational speed of the drill bit and/or the drillstring, and the drilling fluid flow rate. In some cases, the drilling operator is also provided selected information from the downhole sensors such as bit location and direction of travel, downhole pressure, and possibly formation parameters such as resistivity and porosity.

Boreholes are usually drilled along predetermined paths and the drilling of a typical borehole proceeds through various formations. The downhole operating conditions may change and the operator must react to such changes and adjust the surface-controlled parameters to optimize the drilling operations. The drilling parameters typically controlled by the drilling operator to optimize the drilling operations include the weight-on-bit (WOB), drilling fluid flow through the drill pipe (flow rate and pressure), the drillstring rotational speed, axial position of the drillstring and drill bit within the borehole, and the density and viscosity of the drilling fluid. During most conventional drilling operations, the drilling operator adjusts the various surface-controlled drilling parameters in response to, or after, detection of certain downhole conditions.

In general, the drillstring, drill bit, and drilling fluid each input energy into the drilling process. Namely, rotation of the drillstring and drill bit input energy into the drilling process, the axial movement of the drillstring and the drill bit input energy into the drilling process, and the drilling fluid pressure and flow rate input energy into the drilling process. When the energy input by (a) the rotation of the drillstring and drill bit, (b) the flow of drilling fluid, (c) the movement of the drillstring and drill bit, or (d) the combination of (a) thru (c) is uniform and constant over a period of time, it has the potential to create undesirable "steady state" downhole conditions and/or harmonic motions, which may lead to common issues such as stick-slip, insufficient hole cleaning, bit whirl, drill-string whirl, excessive vibrations (lateral and/or axial), or combinations thereof.

As described above, during most conventional drilling operations, the drilling operator adjusts the various surface-controlled drilling parameters in response to, or after, detection of certain undesirable downhole conditions. Usually, the drilling operator monitors the downhole conditions, attempts to identify the occurrence of undesirable downhole conditions, and then takes action at the surface, by adjusting one or more of the surface-controlled drilling parameters, to disrupt the undesirable downhole condition(s). Accordingly, this conventional approach seeks to manually address the downhole issues after they arise. In some cases, by the time the drilling operator has recognized the downhole problem and altered the surface-controlled drilling parameters, damage to the drillstring, the drill bit, and/or other downhole components has already occurred.

Some drilling operations employ predictive models that receive data relating to surface and/or downhole conditions and output a set of recommended values for the drilling parameters (e.g., bit RPM) based on analysis of such measurements. The recommended drilling parameters may be implemented manually or via an automated control systems. However, the physics behind such modeling schemes is complex, and typically depend on accurate measurements of surface and downhole conditions, which are often difficult to obtain in the harsh drilling environment. Consequently, some of the predictive models are less effective than desired.

Accordingly, there is a need in the art for drilling systems and methods that overcome the problems associated with the prior art systems. Such drilling systems and methods would be particularly well received if they offered the potential to proactively disrupt or avoid undesirable steady state conditions and downhole harmonic motions.

BRIEF SUMMARY OF THE DISCLOSURE

These and other needs in the art are addressed in one embodiment by a method for drilling a borehole in an earthen formation. In an embodiment, the method comprises (a) providing a drilling system including a drillstring having a longitudinal axis, a bottom-hole assembly coupled to a lower end of the drillstring, and a drill bit coupled to a lower end of the bottom-hole assembly. In addition, the method comprises (b) rotating the drill bit at a rotational speed. Further, the method comprises (c) applying weight-on-bit to the drill bit and advancing the drill bit through the formation to form the borehole. Still further, the method comprises (d) pumping a drilling fluid down the drillstring to the drill bit. The drilling fluid has a flow rate down the drillstring. Moreover, the method comprises (e) oscillating the rotational speed of the drill bit during (c). The method also comprises (f) generating non-steady state conditions in the borehole during (e).

These and other needs in the art are addressed in another embodiment by a method for maintaining non-steady state conditions in a borehole being drilled in an earthen formation. In an embodiment, the method comprises (a) providing a drilling system including a drillstring having a longitudinal axis, a bottom-hole assembly coupled to a lower end of the drillstring, and a drill bit coupled to a lower end of the bottom-hole assembly. In addition, the method comprises (b) applying torque to the drill bit to rotate the drill bit. The drill bit has a rotational speed and a rotational acceleration. Further, the method comprises (c) applying weight-on-bit to the drill bit to advance the drill bit through the formation to form the borehole. The drill bit has an axial speed and an axial acceleration. Still further, the method comprises (d) pumping a drilling fluid down the drillstring to the drill bit. The drilling fluid has a flow rate down the drillstring and a pressure at an inlet of the drillstring. The rotational speed of the drill bit, the rotational acceleration of the drill bit, the axial speed of the drill bit, the axial acceleration of the drill bit, the flow rate of the drilling fluid down the drillstring, and the pressure of the drilling fluid at the inlet of the drillstring is each a drilling parameter. Moreover, the method comprises (e) controllably oscillating two or more of the following drilling parameters during (c): the rotational speed of the drill bit; the rotational acceleration of the drill bit; the axial speed of the drill bit; the axial acceleration of the drill bit; the flow rate of the drilling fluid down the drillstring; and the pressure of the drilling fluid at the inlet of the drillstring.

These and other needs in the art are addressed in another embodiment by a computer-readable storage medium. In an embodiment, the computer-readable storage medium comprises software, when executed by a processor, causes the processor to (a) receive a predetermined maximum rotational speed for a drillstring, a predetermined minimum rotational speed for the drillstring, and a predetermined set point for the rotational speed of the drill bit. In addition, the software, when executed by the processor, causes the processor to (b) monitor the rotational speed of the drillstring. Further, the software, when executed by the processor, causes the processor to (c) control the rotational speed of the drillstring. Still further, the software, when executed by the processor, causes the processor to (d) oscillate the rotational speed of the drillstring about the predetermined set point for the rotational speed and between the predetermined maximum rotational speed and the predetermined minimum rotational speed.

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

DESCRIPTION OF THE DISCLOSED EMBODIMENTS

Figure 1:
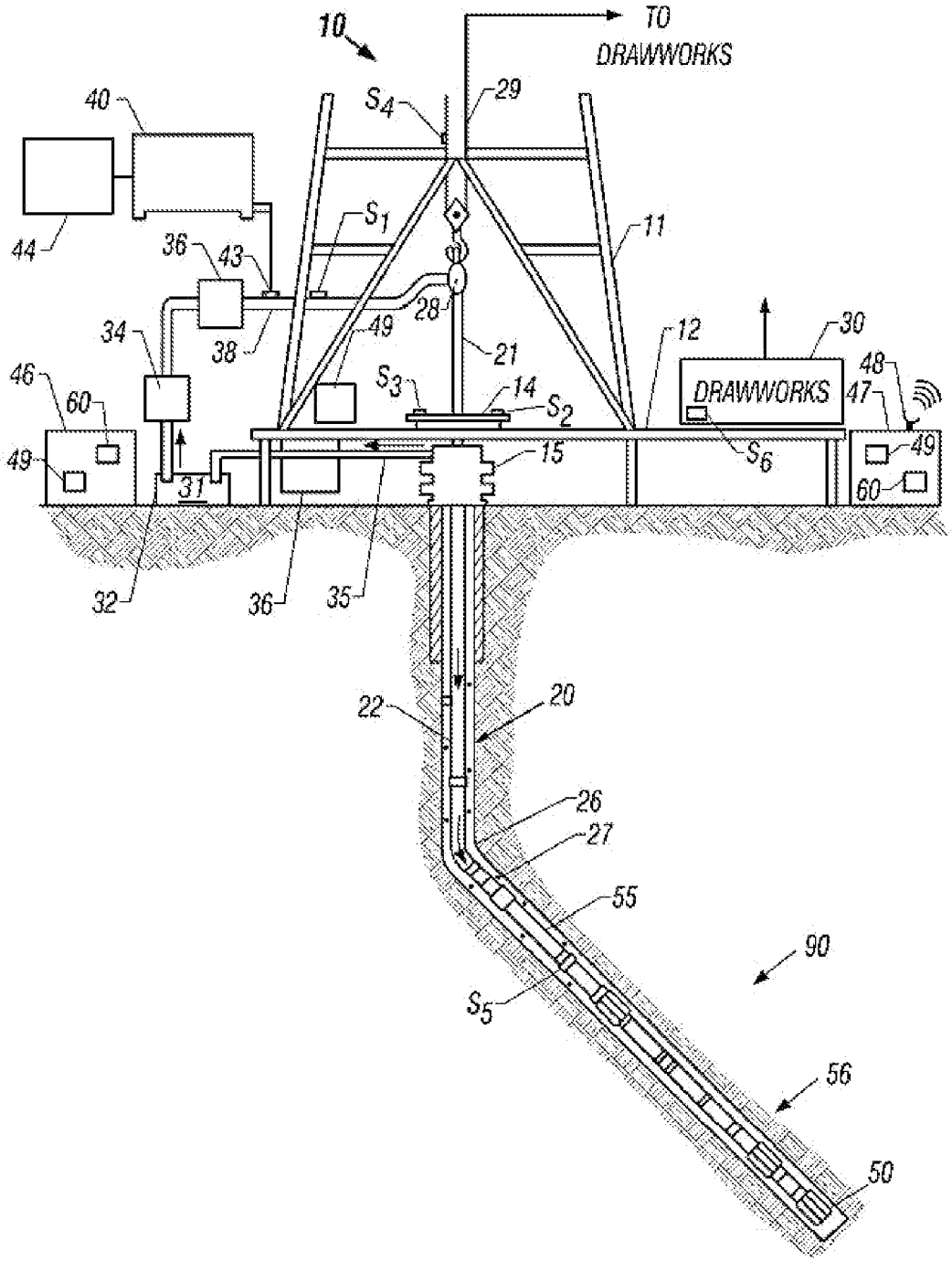
FIG. 1 is a schematic view of an embodiment of a drilling system in accordance with the principles described herein.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections. Further, the terms "axial" and "axially" generally mean along or parallel to a central or longitudinal axis (e.g., the drillstring axis), while the terms "radial" and "radially" generally mean perpendicular to the central or longitudinal axis. For instance, an axial distance refers to a distance measured along or parallel to the central or longitudinal axis, and a radial distance refers to a distance measured perpendicularly from the central or longitudinal axis.

Referring now to FIG. 1, a schematic diagram of an embodiment of a drilling system 10 in accordance with the principles described herein is shown. Drilling system 10 includes a drilling assembly 90 for drilling a borehole 26. In addition, drilling system 10 includes a derrick 11 having a floor 12, which supports a rotary table 14 that is rotated by a prime mover such as an electric motor (not shown) at a desired rotational speed and controlled by a motor controller (not shown). The motor controller may be a silicon controlled rectifier (SCR) system, a Variable Frequency Device (VFD), or other type of suitable controller. In other embodiments, the rotary table (e.g., rotary table 14) may be augmented or replaced by a top drive suspended in the derrick (e.g., derrick 11) and connected to the drillstring (e.g., drillstring 20).

Drilling assembly 90 comprises a drillstring 20 including a drill pipe 22 extending downward from the rotary table 14 through a pressure control device 15 into the borehole 26. The pressure control device 15 is commonly hydraulically powered and may contain sensors for detecting certain operating parameters and controlling the actuation of the pressure control device 15. A drill bit 50, attached to the lower end of drillstring 20, disintegrates the earthen formations when it is rotated with weight-on-bit (WOB) to drill the borehole 26. Drillstring 20 is coupled to a drawworks 30 via a kelly joint 21, swivel 28, and line 29 through a pulley. During drilling operations, drawworks 30 is operated to control the WOB, which impacts the rate-of-penetration of drill bit 50 through the formation. In this embodiment, drill bit 50 may be rotated from the surface by drillstring 20 via rotary table 14 and/or a top drive, rotated by downhole mud motor 55 disposed in drilling assembly 90, or combinations thereof (e.g., rotated by both rotary table 14 via drillstring 20 and mud motor 55, rotated by a top drive and the mud motor 55, etc.). For example, rotation via downhole motor 55 may be employed to supplement the rotational power of rotary table 14, if required, and/or to effect changes in the drilling process. In either case, the rate-of-penetration (ROP) of the drill bit 50 into the borehole 26 for a given formation and a drilling assembly largely depends upon the weight-on-bit and the drill bit rotational speed.

During drilling operations a suitable drilling fluid 31 is pumped under pressure from a mud tank 32 through the drillstring 20 by a mud pump 34. Drilling fluid 31 passes from the mud pump 34 into the drillstring 20 via a desurger 36, fluid line 38, and the kelly joint 21. Drilling fluid 31 is discharged at the borehole bottom through nozzles in face of drill bit 50, circulates to the surface through an annular space 27 radially positioned between drillstring 20 and the sidewall of borehole 26, and then returns to mud tank 32 via a solids control system 36 and a return line 35. Solids control system 36 may include any suitable solids control equipment known in the art including, without limitation, shale shakers, centrifuges, and automated chemical additive systems. Control system 36 may include sensors and automated controls for monitoring and controlling, respectively, various operating parameters such as centrifuge rpm. It should be appreciated that much of the surface equipment for handling the drilling fluid is application specific and may vary on a case-by-case basis.

Various sensors are employed in drilling system 10 for monitoring a variety of surface-controlled drilling parameters and downhole conditions. For example, sensors $S_1$ on line 38 measures and provides information about the drilling fluid flow rate and pressure. In addition, a surface torque sensor $S_2$ measures and provides information about the torque applied to drillstring 20 at the surface, and a downhole torque sensor $S_5$ measures and provides information about the torque applied to drill bit 50. Although torque sensor $S_2$ is used in this embodiment to measure applied torque at the surface, in other embodiments, applied torque may also be calculated based on measurements of the power applied to the top drive or rotary table to rotate the drill string. A rotational speed and acceleration sensor $S_3$ measures and provides information about the rotational speed and acceleration of drillstring 20 and bit 50. Further, a sensor $S_4$ measures and provides information relating to the hook load of drillstring 20 and WOB applied to bit 50. The axial speed and acceleration of drillstring 20 and bit 50 are measured and provided by a position encoder or sensor $S_6$ associated with the rotating drum of drawworks 30. Axial acceleration of the drillstring and the drill bit may also be measured with an accelerometer coupled to the drillstring or one of the tools in the drillstring, such as a MWD or LWD tool, and axial speed may be computed based on the axial acceleration measurements. Additional sensors are associated with the motor drive system to monitor drive system operation. These include, but are not limited to, sensors for detecting motor speed (RPM), winding voltage, winding resistance, motor current, and motor temperature. Still further, other sensors are used to measure and provide information relating to the solids control equipment, and the pressure control equipment (e.g., to indicate hydraulic system status and operating pressures of the blow out preventer, and choke associated with pressure control device 15).

Signals from the various sensors (e.g., sensors $S_1$, $S_2$, $S_3$, $S_4$, $S_5$, $S_6$, etc.) are input to a control system processor 60 located in the toolpusher's cabin 47 or the operator's cabin 46. In general, the processor (e.g., processor 60) may be any suitable device or system for performing programmed instructions including, without limitation, general-purpose processors, digital signal processors, and microcontrollers configured to perform instructions provided by software programming. Processor architectures generally include execution units (e.g., fixed point, floating point, integer, etc.), storage (e.g., registers, memory, etc.), instruction decoding, peripherals (e.g., interrupt controllers, timers, direct memory access controllers, etc.), input/output systems and devices (e.g., serial ports, parallel ports, etc.), and various other components and sub-systems. Software programming can be stored in a computer readable medium. Exemplary computer readable media include semiconductor memory, optical storage, and magnetic storage.

Referring still to FIG. 1, processor 60 is operably coupled with drawworks 30 and other mechanical, hydraulic, pneumatic, electronic, and wireless subsystems of drilling system 10 to control various drilling parameters. In particular, based on input of the various sensors, processor 60 can automatically adjust drilling parameters including, without limitation, the weight-on-bit applied to bit 50; the torque applied to drillstring 20 and drill bit 50 (via rotary table 14, a top drive, mud motor 55, or combinations thereof); the rotational speed and acceleration of drillstring 20 and drill bit 50; the axial position, speed, and acceleration of drillstring 20 and drill bit 50; and the pressure and flow rate of drilling fluid 31 flowing down drillstring 20 to drill bit 50.

In addition, processor 60 permits input of a predetermined maximum and minimum value for each drilling parameter including, without limitation, a predetermined maximum and minimum torque applied to the drillstring and drill bit; a predetermined maximum and minimum rotational speed for the drillstring and drill bit; a predetermined maximum and minimum acceleration for the drillstring and drill bit; a predetermined maximum and minimum axial speed for the drillstring and drill bit; a predetermined maximum and minimum acceleration for the drillstring and drill bit; a predetermined maximum and minimum flow rate for the drilling fluid; and a predetermined maximum and minimum pressure for the drilling fluid. In this embodiment, input of the desired predetermined maximum and minimum value for each drilling parameter is accomplished via displays 49. However, in other embodiments, other suitable means may be employed to communicate the desired, predetermined maximum and minimum for each drilling parameter including, without limitation, wireless communications, a keyboard, a mouse, or combinations thereof. Further, the desired predetermined maximum and minimum drilling parameters may be input at the rig or from a remote location. As an alternative to user input predetermined minimum and maximum values for each drilling parameter, processor 60 may dynamically calculate or determine minimum and maximum values for each drilling parameter based on measurements as drilling progresses.

Processor 60 also receives and interprets signals from the various rig sensors, downhole sensors, and other input data from service contractors, and outputs the received and interpreted data to the operator via displays 49. Based on a comparison of the measured data with the well plan models, and a comparison of the measured data with the minimum and maximum values for each drilling parameter, processor 60 determines if any adjustments are necessary to maintain the current well plan, and displays status and warning information via displays 49. Thus, in this embodiment, displays 49 provide a user interface for both inputting and outputting information. Multiple display screens (e.g., displays 49), depicting various rig operations, may be available for user call up.

Based on a comparison of the measured data with the well plan models and the minimum and maximum values for the drilling parameters, processor 60 may (a) suggest the appropriate corrective action and request authorization to implement such corrective action, or (b) automatically implement the appropriate corrective action, thereby minimizing potential delays in relying on the manual adjustment of surface-controlled drilling parameters. The measured data and status information may also be communicated using hardwired or wireless techniques 48 to remote locations off the well site. Processor 60 is preferably configured and adapted to execute software instructions that allow processor 60 to implement drilling method 200 described in more detail below with respect to FIG. 2.

In this embodiment, drilling assembly 90 also includes an MWD and/or LWD assembly 56 that contain sensors for determining drilling dynamics, directional, formation parameters, and downhole conditions. In this embodiment, the sensed values are transmitted to the surface via mud pulse telemetry and received by a sensor 43 mounted in line 38. The pressure pulses are detected by circuitry in receiver 40 and the data processed by a receiver processor 44. Although mud pulse telemetry is employed in this embodiment, in general, any suitable telemetry scheme may be employed to communicate data from downhole sensors to the surface including, without limitation, electromagnetic telemetry, acoustic telemetry, or hardwire connections (e.g., wired drill pipe).

Although FIG. 1 is generally drawn a land rig, embodiments disclosed herein are also equally applicable to offshore drilling systems and methods. Further, various components of the drilling system 10 can be automated to various degrees, as for example, use of a top drive instead of a kelly.

Figure 2:
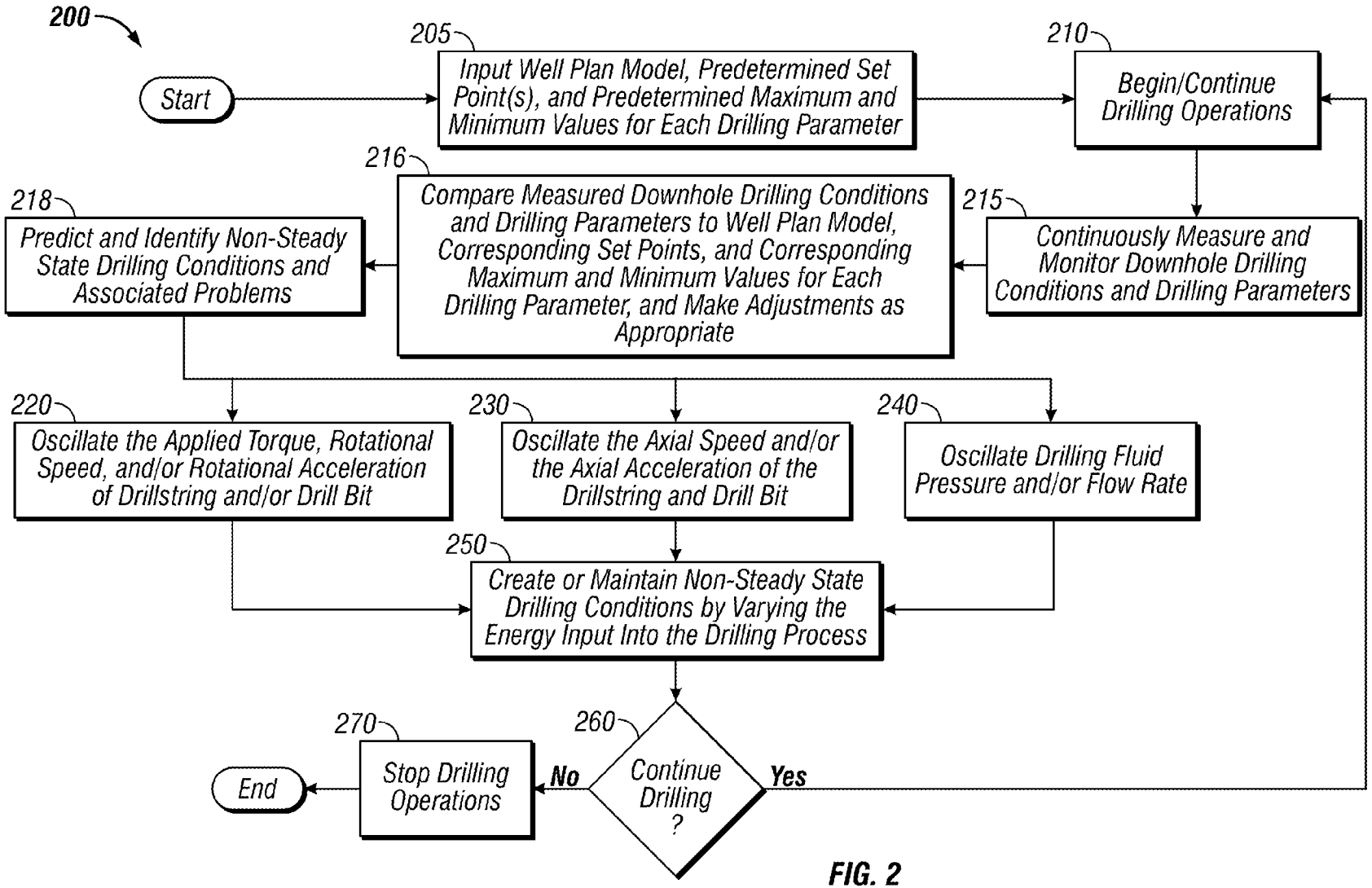
FIG. 2 is a schematic of an embodiment of a method for drilling in accordance with the principles described herein.

Referring now to FIG. 2, an embodiment of a drilling method 200 in accordance with the principles described herein is schematically shown. Drilling method 200 is implemented by drilling system 10 previously described. In general, drilling method 200 includes steps to vary (continuously or periodically) and/or oscillate the energy input into the drilling process to improve drilling efficiency, and disrupt, mitigate, and/or preemptively prevent downhole "steady state" conditions and associated problems such as stick-slip, hole cleaning issues, bit whirl, drill-string whirl, and excessive lateral or axial vibrations. In general, energy is input into the drilling system by (a) the rotation of the drillstring and drill bit, (b) the axial movement of the drillstring and drill bit, and (c) the flow of drilling fluid. However, as will be described in more detail below, drilling method 200 introduces energy variations and oscillations into the drilling process via controlled manipulation of drilling parameters including, without limitation, the applied torque, rotational speed, and rotational acceleration of the drillstring and drill bit; the axial speed and acceleration of the drillstring and drill bit; and the drilling fluid pressure and flow rate. The controlled manipulation of the drilling parameters may be performed manually by the drilling operator, but are preferably automated via a drilling software application similar to DrillLink/CyberLink available from National Oilwell Varco, L.P. of Houston, Tex. and associated drilling system such as system 10 previously described.

To initiate or commence method 200, the well plan model, the predetermined set point(s) for each drilling parameter (e.g., applied torque, rotational speed, and rotational acceleration of the drillstring and the drill bit; the axial speed and acceleration of the drillstring and the drill bit; and the flow rate and pressure of the drilling mud), and the predetermined minimum and maximum values for each drilling parameter are input into the drilling system in block 205. For example, in drilling system 10 previously described, the well plan model, the set points, and the predetermined minimum and maximum values for each drilling parameter are input into processor 60 via display 49 or other suitable input mechanism. Next, in block 210, drilling operations begin by applying torque to rotate the drill bit (e.g., drill bit 50), pumping pressurized drilling fluid (e.g., fluid 31) down the drillstring (e.g., drillstring 20), applying weight-on-bit, and advancing the drillstring and drill bit through the earthen formation to form a borehole (e.g., borehole 26). As previously described, the drill bit may be rotated by the drillstring via the rotary table, top drive, by downhole mud motors, or combinations thereof.

During drilling, the downhole drilling conditions and the drilling parameters are continuously measured and monitored in block 215. The various sensors in the bottomhole assembly of the drilling system may measure downhole conditions such as temperature, pressure, vibrations, formation characteristics, etc. Downhole sensors may also be used to measure drilling parameters such as axial position, speed, and acceleration of the drill bit, and the applied torque, rotational speed and acceleration of the drill bit. Further, various sensors at the surface may measure drilling parameters such as mud pump speed, drilling fluid pressure and flow rate, top drive speed and acceleration, applied torque, rotational speed, and acceleration of the drillstring and drill bit, and axial speed and acceleration of the drillstring and drill bit. For example, in drilling system 10 previously described, the various sensors (e.g., sensors $S_1$, $S_2$, $S_3$, $S_4$, $S_5$, $S_6$, etc.) measure downhole drilling conditions and the drilling parameters, the measured data is communicated to processor 60, and processor 60 tracks and monitors the measured data.

Moving now to block 216, the measured and collected data relating to the downhole conditions and the drilling parameters is compared to the well plan model, the set points, and the maximum and minimum values for each drilling parameter. For example, in drilling system 10 previously described, each actual, measured drilling parameter (e.g., rotational speed of the drill bit 50) is compared to its corresponding set point, and predetermined minimum and maximum values (e.g., set point and predetermined minimum and maximum values for drill bit rotational speed) by processor 60. One purpose of this comparison is to ensure each drilling parameter is maintained between its corresponding predetermined maximum and minimum values. For example, if the measured, actual drilling parameter exceeds the predetermined maximum value or is below the predetermined minimum value, processor 60 will notify the operator and/or automatically instruct the appropriate subsystems within drilling system 10 to adjust the drilling parameter such that it is between its corresponding predetermined maximum and minimum values.

Referring still to FIG. 2, the measured and collected data relating to the downhole conditions and the drilling parameters is also used to predict and/or identify undesirable steady-state conditions and associated problems according to block 218. For example, when the drill bit is rotated by the drillstring, a measured, actual rotational speed of the drillstring at the surface that is relatively constant and a measured, actual rotational speed of the drill bit that is changing (i.e., not constant) is evidence of possible stick slip—as the bit or bottomhole assembly binds with the formation, its rotational speed slows, and torsion builds in the pipe. Consequently, an unexpected increase in applied torque may also be detected and indicate potential stick slip conditions downhole.

Moving now to blocks 220, 230, 240, during drilling, one or more drilling parameters are oscillated to create or maintain non-steady state drilling conditions by varying the energy input into the drilling process according to block 250. As used herein, the terms "oscillate" and "oscillation" refer to the repeated increase and decrease in the value of a drilling parameter or energy input into the drilling system over time. It should be appreciated that these oscillations in the one or more drilling parameters are intentional and controlled oscillations, which may be performed manually the driller through control systems at the surface or performed automatically by a processor (e.g., processor 60) and associated software capable of manipulating the control systems at the surface. As will be described in more detail below, the oscillations of the one or more drilling parameters according to steps 220, 230, 240, and the oscillation of the energy input into the drilling process according to step 250 are preferably about the corresponding set points (i.e., above and below the corresponding set points), between the corresponding predetermined maximum and minimum values, and random (i.e., random frequencies and amplitudes) to avoid potential resonance conditions. Further, the periods of the oscillations are preferably relatively small (e.g., less than 10 seconds).

In block 220, the applied torque, the resulting rotational speed (e.g., RPM), and the resulting rotational acceleration of the drillstring and drill bit are controllably varied and oscillated over time. Such adjustments are preferably performed continuously or relatively frequently (e.g., every few seconds), thereby resulting in the oscillation of the applied torque, rotational speed, and rotational acceleration of the drillstring and drill bit over time. As previously described, the terms "oscillate" and "oscillation" refer to the repeated increase and decrease in the value of a drilling parameter (or energy input into the drilling system) over time. Thus, for example, oscillation in the rotational speed of a drill bit refers to the repeated increase and decrease in the rotational speed of the drill bit over time. It should be appreciated that the torque applied to the drillstring impacts the rotational speed and acceleration of the drillstring and the drill bit. However, the torque applied to the drill bit by the downhole mud motor impacts the rotational speed and acceleration of the drill bit, but not the rotational speed or acceleration of the drillstring.

Figure 3:
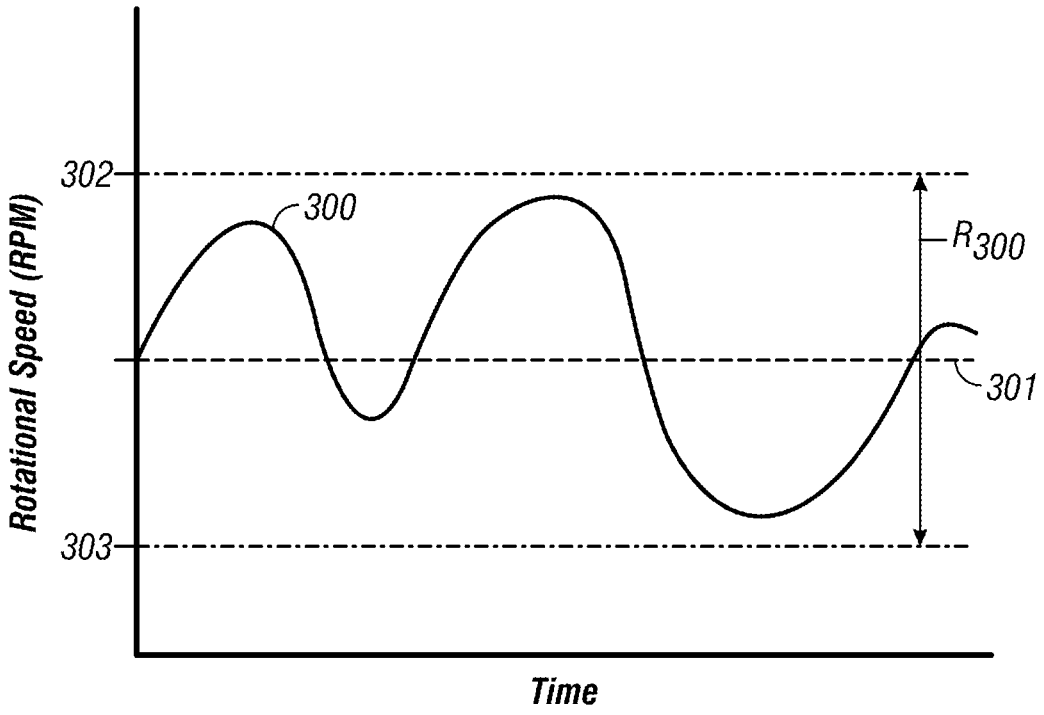
FIG. 3 is a graphical illustration of the oscillation of the rotational speed of a drillstring over time.
Figure 4:
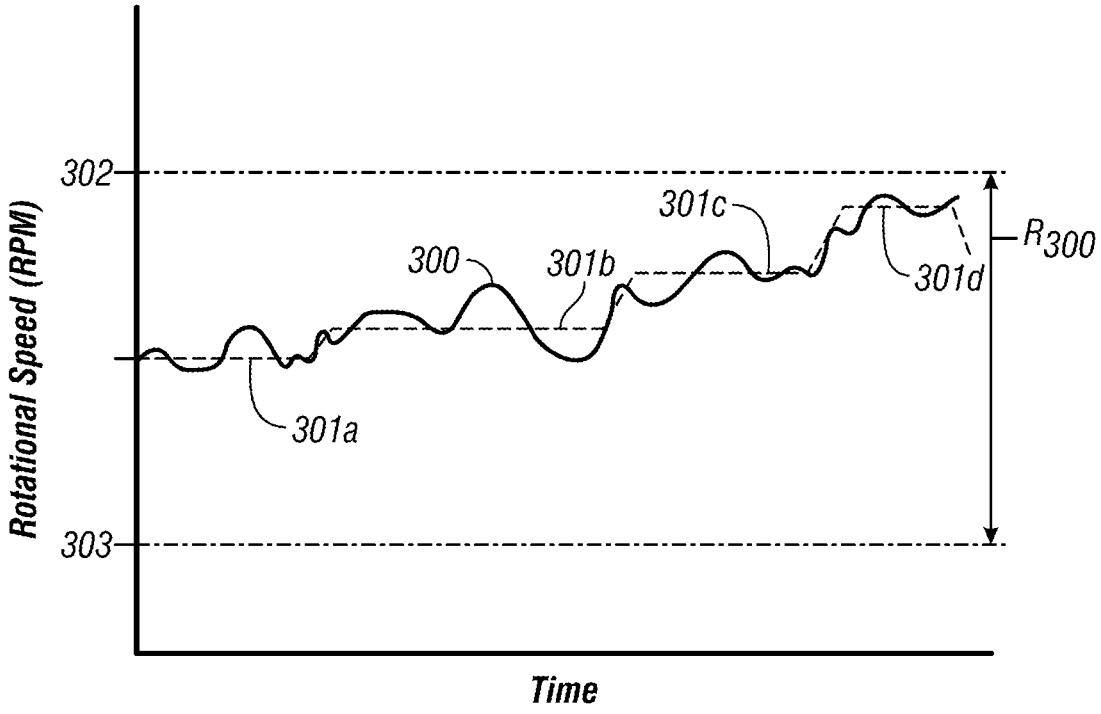
FIG. 4 is a graphical illustration of the oscillation of the rotational speed of a drillstring over time.

The period and the amplitude of the oscillations in each of the applied torque, rotational speed, and rotational acceleration may be random or non-random over time, but are preferably controlled and managed to (a) oscillate about one or more predetermined set points for the applied torque, rotational speed, and rotation acceleration, respectively (i.e., each cycle moves above and below the predetermined set point over time), and (b) remain between one or more predetermined maximum and minimum applied torques, rotational speeds, and rotational accelerations, respectively, as are prescribed by the well plan for the particular well being drilled. Further, the periods of the oscillations in the applied torque, rotational speed, and rotational acceleration are preferably less than one minute, more preferably less than 10 seconds, and even more preferably less than 5 seconds. For example, in FIG. 3, the oscillation of the rotational speed 300 of an exemplary drill bit (e.g., drill bit 50) over time is graphically shown. In this embodiment, the rotational speed 300 of the drill bit is oscillated over time generally about a predetermined rotational speed set point 301. In other words, rotational speed 300 repeatedly moves above and below set point 301 over time. In addition, the rotational speed 300 of the drill bit is maintained within a predetermined range $R_{300}$ defined by a predetermined upper or maximum rotational speed 302 and a predetermined lower or minimum rotational speed 303. As another example, in FIG. 4, the oscillation of the rotational speed 300 of the drill bit over time is graphically shown. The rotational speed 300 of the drill bit is maintained within the predetermined range $R_{300}$ defined by predetermined upper and lower rotational speeds 302, 303, respectively, as previously described. However, in FIG. 4, there are multiple predetermined rotational speed set points 301*a*, 301*b*, 301*c*, 301*d*, about which the rotational speed 300 oscillates over different segments of time. In the embodiments shown in FIGS. 3 and 4, the amplitude and the period of the rotational speed 300 oscillations vary randomly over time, and the oscillations in the rotational speed 300 are generally sinusoidal. However, in general, the amplitude of each of the applied torque, rotational speed, and rotational acceleration oscillations, the periods of each of the applied torque, rotational speed, and rotational acceleration oscillations, or both may be random, uniform, or constant over time. Further, in general, the oscillations in the applied torque, rotational speed, and rotational acceleration oscillations may be trapezoidal, triangular, rectangular, sinusoidal, or combinations thereof.

Without being limited by this or any particular theory, everything else being constant, the oscillations in the applied torque, rotational speed, and rotational acceleration of the drillstring and drill bit result in the oscillation of the energy input into the drilling process by the drillstring and drill bit. Further, without being limited by this or any particular theory, the oscillation of the energy input by the drillstring and drill bit is directly related to the oscillation of the applied torque, rotational speed, and rotational acceleration of the drillstring and drill bit. Thus, when the absolute value of any one or more of the applied torque, rotational speed, and rotational acceleration of the drillstring and drill bit increases, the associated energy input into the drilling process increases. By oscillating the applied torque, rotational speed, and rotational acceleration of the drillstring and drill bit, and hence oscillating the energy input into the drilling process by the drillstring and drill bit, embodiments described herein offer the potential to proactively disrupt, mitigate and/or preemptively prevent the formation of undesirable steady state downhole conditions, harmonic motions, and associated problems.

Referring again to FIG. 2, in block 230, the axial speed and the axial acceleration of the drillstring and drill bit are controllably varied and oscillated over time. Such adjustments are preferably performed continuously or relatively frequently over time (e.g., every few seconds), thereby resulting in the oscillation of the axial speed and axial acceleration of the drillstring and drill bit over time. It should be appreciated that the drill bit is coupled to the lower end of the drillstring, and thus, the axial position of the drill bit is affected by changes in the axial position in the drillstring. As previously described, the terms "oscillate" and "oscillation" refer to the repeated increase and decrease in the value of a drilling parameter (or energy input into the drilling system) over time. Thus, for example, oscillation in the axial speed of a drill bit refers to the repeated increase and decrease in the axial speed of the drill bit over time.

Figure 5:
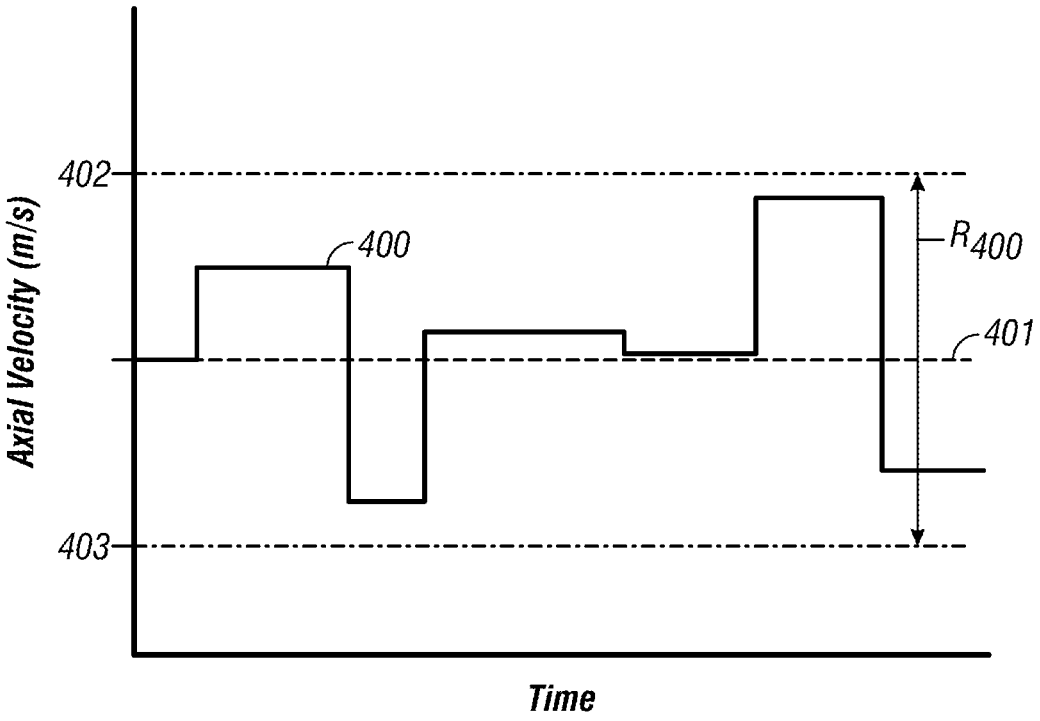
FIG. 5 is a graphical illustration of the oscillation of the axial speed of a drillstring and drill bit over time.

The period and amplitude of the oscillations in each of the axial speed and axial acceleration may be random or non-random over time, but are preferably controlled and managed to (a) oscillate about one or more predetermined set point(s) for the axial speed and axial acceleration, respectively (i.e., each cyclically moves above and below a predetermined set point over time), and (b) remain between one or more predetermined maximum and minimum axial speeds and accelerations, respectively, as are prescribed by the well plan for the particular well being drilled. Further, the periods of the oscillations in the axial speed and axial acceleration are preferably less than one minute, more preferably less than 10 seconds, and even more preferably less than 5 seconds. For example, in FIG. 5, the oscillation of the axial speed 400 of the drillstring is graphically shown. In this embodiment, the axial speed 400 of the drillstring is oscillated over time generally about a predetermined set point 401 for the axial speed 400. In other words, axial speed 400 repeatedly moves above and below set point 401 over time. In addition, the axial speed 400 is maintained within a predetermined range $R_{400}$ defined by a predetermined upper or maximum axial speed 402 and a predetermined lower or minimum axial speed 403. In this embodiment, the amplitude and the period of the axial speed 400 oscillations vary randomly over time, and the oscillations in the axial speed 400 are generally rectangular. However, in general, the amplitude of each of the axial speed and acceleration oscillations, the periods of each of the axial speed and acceleration oscillations, or both may be random, uniform, or constant over time. Further, in general, the oscillations in the axial speed and acceleration oscillations may be trapezoidal, triangular, rectangular, sinusoidal, or combinations thereof.

Without being limited by this or any particular theory, everything else being constant, the oscillations in the axial speed and axial acceleration of the drillstring and drill bit result in the oscillation of the energy input into the drilling process by the drillstring and drill bit. Further, without being limited by this or any particular theory, the oscillation of the energy input by the axial movement of the drillstring and drill bit is directly related to the oscillation in the axial speed and acceleration of the drillstring and drill bit. Thus, when the absolute value of one or both of the axial speed and axial acceleration of the drillstring and drill bit increases, the associated energy input into the drilling process increases. By oscillating the axial speed and acceleration of the drillstring and drill bit, and hence oscillating the energy input into the drilling process by the drillstring and drill bit, embodiments described herein offer the potential to proactively disrupt, mitigate and/or preemptively prevent the formation of undesirable steady state downhole conditions, harmonic motions, and associated problems.

Referring again to FIG. 2, in block 240, the drilling fluid pressure and flow rate are controllably varied and oscillated over time. Such adjustments in the drilling fluid flow rate and pressure are preferably performed continuously or relatively frequently over time (e.g., every few seconds), thereby resulting in the oscillation of the drilling fluid flow rate and pressure over time. In this embodiment, the drilling fluid pressure and flow rate are adjusted by ramping up and down the mud pumps strokes per minute. Further, the oscillations in the flow rate and/or pressure of the drilling mud may be achieved by repeatedly throttling one or more mud pumps at the surface up and down. It should be appreciated that in embodiments employing downhole mud-motors to rotate the drill bit, oscillations in drilling fluid flow rate and pressure will result in mud-motor rotational speed oscillations, and hence, oscillations in drill bit cutting speed. As previously described, the terms "oscillate" and "oscillation" refer to the repeated increase and decrease in the value of a drilling parameter (or energy input into the drilling system) over time. Thus, for example, oscillation in the flow rate of drilling mud refers to the repeated increase and decrease in the flow rate of the drilling mud over time.

Figure 6:
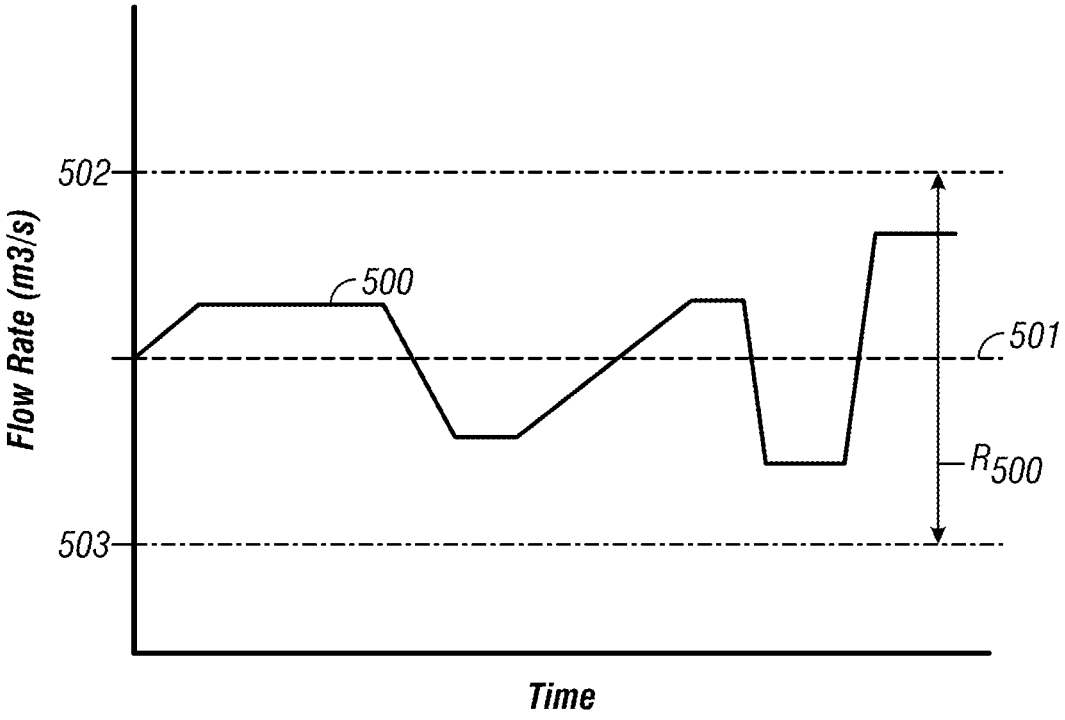
FIG. 6 is a graphical illustration of the oscillation of the flow rate of drilling fluid over time.

The period and amplitude of the oscillations in each of the drilling fluid pressure and flow rate may be random or non-random over time, but are preferably controlled and managed to (a) oscillate about one or more predetermined set point(s) for the pressure and flow rate, respectively (i.e., each cyclically moves above and below a predetermined set point over time), and (b) remain between one or more predetermined maximum and minimum pressure and flow rate, respectively, as are prescribed by the well plan for the particular well being drilled. Further, the periods of the oscillations in the axial speed and axial acceleration are preferably less than one minute, more preferably less than 10 seconds and even more preferably less than 5 seconds. For example, in FIG. 6, the variation of the drilling fluid flow rate 500 is graphically shown. In this embodiment, the drilling fluid flow rate 500 is oscillated over time generally about a predetermined set point 501 for the flow rate 500. In other words, flow rate 500 repeatedly moves above and below set point 301 over time. In addition, the flow rate 500 is maintained within a predetermined range $R_{500}$ defined by a predetermined upper or maximum flow rate 502 and a predetermined lower or minimum flow rate 503. In this embodiment, the amplitude and the period of the flow rate 500 oscillations vary randomly with time, and the oscillations in the flow rate 500 are generally trapezoidal. However, in general, the amplitude of each of the drilling flow rate and pressure oscillations, the periods of each of the drilling flow rate and pressure oscillations, or both may be random, uniform, or constant over time. Further, in general, the oscillations in the flow rate and pressure may be may be trapezoidal, triangular, rectangular, sinusoidal, or combinations thereof.

Without being limited by this or any particular theory, everything else being constant, the oscillations in the drilling fluid flow rate and pressure result in the oscillation of the energy input into the drilling process by the drilling fluid. Further, without being limited by this or any particular theory, the oscillations in the energy input by the drilling fluid are directly related to the oscillations in the drilling fluid flow rate and pressure. Thus, when the drilling fluid flow rate and pressure increase, the associated energy input into the drilling process by the drilling fluid increases. By oscillating the drilling fluid flow rate and pressure, and hence oscillating the energy input into the drilling process by the drilling fluid, embodiments described herein offer the potential to proactively disrupt, mitigate and/or preemptively prevent the formation of undesirable steady state downhole conditions, harmonic motions, and associated problems. For example, the oscillation of the drilling fluid flow rate and pressure may disrupt and/or prevent the formation of undesirable eddys in the drilling fluid flow, as well as steady-state movements and settling of the formation cuttings. Such eddys and steady-state movements of the formation cuttings may keep the cuttings from effectively circulating out of the hole. Accordingly, oscillating the drilling fluid flow rate and pressure offer the potential to enhance cuttings removal efficiency.

In drilling operations employing mud pulse telemetry, the geometry of the waves representative of the oscillations in the drilling fluid flow rate and pressure, the predetermined set point for the drilling fluid flow rate and pressure, and the predetermined minimum and maximum values for the drilling fluid flow rate and pressure are preferably configured to ensure adequate communication of information via mud pulses in the drilling fluid (i.e., minimal or no interference with mud pulse communications).

Referring again to FIG. 2, in block 220 the applied torque, rotational speed, and rotational acceleration of the drillstring and drill bit are varied over time to vary the associated energy input into the drilling process by the drillstring and the drill bit, thereby offering the potential to avoid, disrupt, and/or preemptively prevent downhole steady state conditions and associated problems (e.g., stick slip, hole cleaning deficiencies, etc.). In addition, in block 230, the axial speed and acceleration of the drillstring and drill bit are varied over time to vary the associated energy input into the drilling process by the drillstring and drill bit, thereby also offering the potential to avoid, disrupt, and/or preemptively prevent downhole steady state conditions and associated problems (e.g., stick slip, hole cleaning deficiencies, etc.). Lastly, in block 240, the drilling fluid pressure and flow rate are varied over time to vary the associated energy input into the drilling process by the drilling fluid, thereby also offering the potential to avoid, disrupt, and/or preemptively prevent downhole steady state conditions and associated problems (e.g., stick slip, hole cleaning deficiencies, etc.). In general, the oscillation of the drilling parameters (e.g., the applied torque, rotational speed, and rotational acceleration of the drillstring and drill bit, the axial speed and acceleration of the drillstring and drill bit, and the drilling fluid flow rate and pressure) may be directly or indirectly controlled by surface means (e.g., top drive, block position, mud pumps, etc.), or via downhole means (e.g., mud-motor, drilling fluid bypasses, etc.).

Moving now to block 250, the oscillations in drilling parameters over time according to blocks 220, 230, 240 are intentionally controlled and managed such that the combined effect is the creation or maintenance of non-steady state downhole drilling conditions. The non-steady state conditions created in block 250 may be in response to the detection of undesirable steady-state conditions or associated problems (e.g., stick slip) in step 216, or maintained continuously, or for select periods of time, thereby preemptively preventing, avoiding, and/or disrupting the formation of steady-state conditions and associated problems.

Referring still to FIG. 2, creation or maintenance of the non-steady state conditions in block 250 are preferably achieved by varying the total energy input into the drilling process by the rotation of the drillstring and the drill bit (i.e., energy associated with the application of torque to the drillstring and the drill bit, and the resulting rotational speed and acceleration of the drillstring and the drill bit), the axial movement of the drillstring and the drill bit (i.e., energy associated with the axial speed and acceleration of the drillstring and the drill bit), and the flowing drilling mud (i.e., energy associated with the flow rate and pressure of the drilling mud) over time. Although applied torque, rotational speed, rotational acceleration, axial speed, axial acceleration, flow rate, and pressure are each oscillated in blocks 220, 230, 240, in general, the total energy input into the drilling system by these parameters may be oscillated by oscillating any one or more of these drilling parameters, continuously or periodically, over time.

Figure 7:
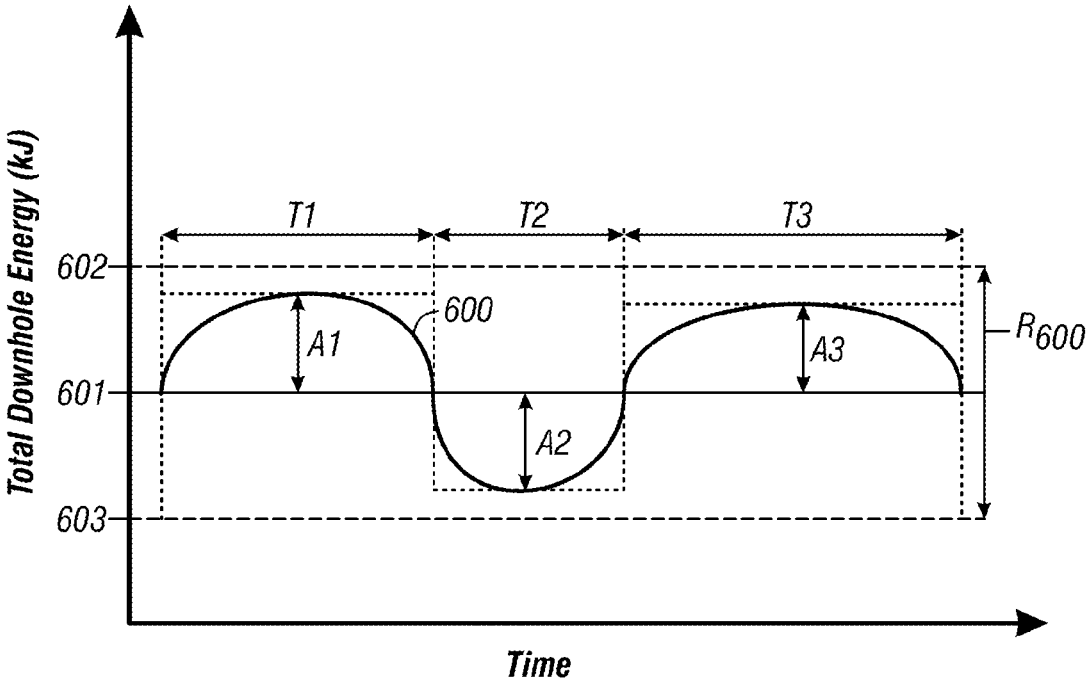
FIG. 7 is a graphical illustration of the oscillation, over time, of the total downhole energy input by the rotation of the drillstring and the drill bit, the axial movement of the drillstring and the drill bit, and the flow of drilling mud.
Figure 8:
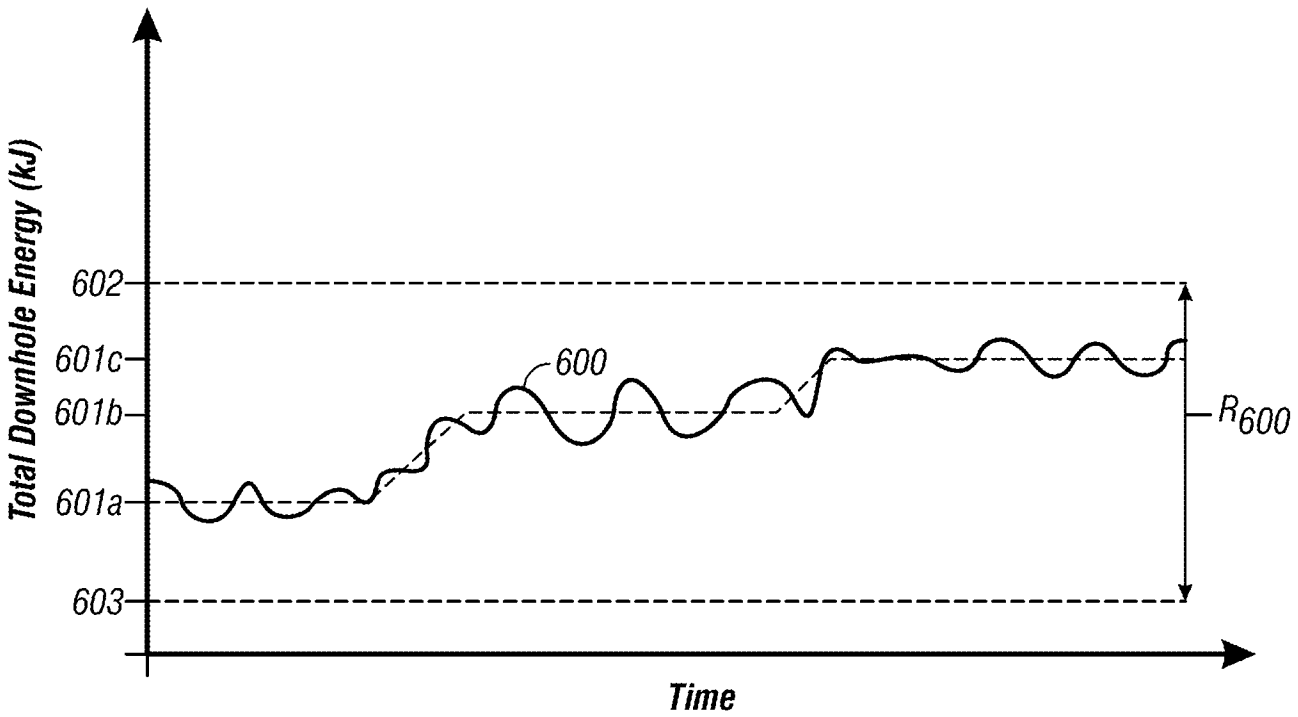
FIG. 8 is a graphical illustration of the oscillation, over time, of the total downhole energy input by the rotation of the drillstring and the drill bit, the axial movement of the drillstring and the drill bit, and the flow of drilling mud.

The period and amplitude of the oscillations in the total energy input into the drilling system by these parameters may be random or non-random over time, but are preferably controlled and managed to (a) oscillate about one or more predetermined set point(s) (i.e., cyclically moves above and below a predetermined set point over time), and (b) remain between one or more predetermined maximum and minimum as may be described by the well plan for the particular well being drilled. Further, the periods of the oscillations in the total energy input into the drilling process by these parameters are preferably less than one minute, more preferably less than 10 seconds and even more preferably less than 5 seconds. For example, in FIG. 7, the oscillation of the downhole energy 600 input into the drilling process by rotation of the drillstring and drill bit, axial movement of the drillstring and the drill bit, and the flowing drilling mud is graphically shown. In this embodiment, the downhole energy 600 is oscillated over time generally about a predetermined set point 601. In other words, downhole energy 600 repeatedly moves above and below set point 601 over time. In addition, the energy 600 is maintained within a predetermined range $R_{600}$ defined by a predetermined upper or maximum downhole energy 602 and a predetermined lower or minimum downhole energy 603. In this embodiment, the amplitudes $A_1$, $A_2$, $A_3$ of the downhole energy oscillations vary with time, and further, the periods $T_1$, $T_2$, $T_3$ of the downhole energy oscillations also vary with time. However, in general, the amplitudes of the downhole energy oscillations, the periods of the downhole energy oscillations, or both may be random, uniform, or constant over time. Further, in this embodiment, the oscillation in the total downhole energy 600 is generally sinusoidal, however, in general, the oscillations in the total downhole energy 600 may be triangular, rectangular, sinusoidal, trapezoidal, or combinations thereof. As another example, in FIG. 8, the total downhole energy 600 is maintained within the predetermined range $R_{600}$ defined by predetermined upper and lower total downhole energy limits 602, 603, respectively. However, in FIG. 8, there are multiple predetermined set points 601*a*, 601*b*, 601*c* about which the total downhole energy 600 oscillates over time.

Referring again to FIG. 2, in block 260, drilling method 200 inquires as to whether drilling should continue. Typically, drilling continues until there is a problem sufficient to halt drilling (e.g., severe damage to downhole component) or the desired depth has been attained. As long as drilling is ongoing, process 200 cycles back to block 210 for the oscillation in one or more of the drilling parameters in blocks 220, 230, 240, and the creation or maintenance of non-steady state conditions according to block 250. However, if a decision is made to stop drilling in block 260, the drilling operations cease according to block 270. Thus, as long as drilling is ongoing, drilling method 200 monitors the downhole drilling conditions and drilling parameters in block 215; compares the measured and monitored downhole conditions and drilling parameters to the well plan model, corresponding set points and maximum and minimum values for each drilling parameter in block 216; predicts and identifies non-steady state drilling conditions and associated problems in block 218; oscillates the drilling parameters and associated energies in blocks 220, 230, 240; and creates or maintains non-steady state conditions in block 250.

To enable the continuous monitoring of the downhole conditions (e.g., temperature, vibrations, rotational speeds, axial position, pressure, etc.), the operational parameters of the surface equipment (e.g., mud pump speed), as well as the timely control and management of the drilling parameters (applied torque, rotational speed and acceleration of drillstring and drill bit, axial speed and acceleration of the drillstring and drill bit, and drilling fluid pressure and flow rate), process 200 is preferably implemented by a semi-automated or fully automated drilling system (e.g., system 10 previously described) including a drilling software application that allows for entry of predetermined set points and upper and lower limits for each drilling parameter, as well as control of the various drilling systems that enable manipulation of the drilling parameters as appropriate. Such a software solution is preferably designed for use by drilling engineers and is located at the rig or remotely via a computer with internet access. The solution may be an application addition to the DrillLink/CyberLink solution currently offered by National Oilwell Varco, L.P. of Houston, Tex. The solution could be sold or leased. Users would be able to establish operating parameters based on their knowledge of the well plan, in turn they would simply activate the solution and continue their job functions while the system operates.

Embodiments disclosed herein offer the potential to avoid, disrupt, and/or preemptively prevent downhole steady state conditions and undesirable harmonic behaviors, thereby offering the potential to reduce, minimize, and/or eliminate problems associated with downhole steady state conditions (e.g., stick-slip, hole cleaning, bit whirl, drill-string whirl, excessive lateral or axial vibration, etc.). In addition, embodiments disclosed herein may be employed to proactively introduce or maintain desirable harmonic downhole conditions (or sets of desirable harmonic downhole conditions) to mitigate issues such as stick-slip, hole cleaning, bit whirl, drill-string whirl, excessive lateral or axial vibration, etc. By the introduction of variations in the energy input into the drilling process by select drilling parameters, steady state conditions (leading to dysfunction of the drilling process) may be avoided. For example, in conventional drilling systems and processes, stick slip may be detected (after the fact) by observing constant surface drillstring speed rotational and varying downhole drill bit rotational speeds due to the bit or BHA binding with the formation. The driller may also observe see the increase in torque as torsion builds in drillstring due to differences in the rotational speed of the drillstring at the surface and the drillstring downhole proximal the drill bit. In response, the driller typically reduces the rotational speed of the drillstring at the surface (e.g., by reducing top drive RPM), completely stops rotation of the drillstring, and slowly release the tensional energy stored in the drillstring by repeatedly releasing and resetting the drive brake. Next, the driller will typically lift the drillstring, resume rotation of the drillstring and drill bit (off bottom), slowly lower the drill bit back to bottom, increase WOB, and resuming drilling. However, in accordance with process 200, by oscillating one or more of the drilling parameters above and below its corresponding set point between a maximum and minimum value, stick slip may preemptively be avoided before it arises. As another example, dysfunctional drillstring vibrations exacerbated by resonance may be avoided. Specifically, as the bit cuts the rock, it may start to "bounce." The bit does not actually come off bottom, however, the WOB measured at the surface begins to bounce up and down at a relatively high frequency. If the energy imparted to the drilling system from the surface is in resonance with this reaction, the amplitude of the bounce may increase, which may be translated into radial and torsional vibrations. Although real-time measurement and control of resonance is challenging, preemptive avoidance of such resonance conditions may be achieved by oscillating the energy input into the drilling process over time according to embodiments described herein.

Although embodiments described herein relate to the oscillation of one or more drilling parameters during drilling operations to create or maintain non-steady state downhole conditions, it should be appreciated that the general concept of varying and oscillating operational parameters to create or maintain non-steady state downhole conditions may be applied to other downhole processes such as cementing operations, tripping operations, casing operations, etc. For example, during cementing operations, the flow rate and/or pressure of the cement pumped downhole may be oscillated over time about corresponding predetermined set points and between corresponding maximum and minimum and maximum values. As another example, during casing operations, one or more of the rotational speed, rotational acceleration, axial speed, and axial acceleration of the casing being run into the borehole may be oscillated over time about corresponding predetermined set points and between corresponding maximum and minimum and maximum values. As still yet another example, while tripping into or out of a borehole, the rotational speed, rotational acceleration, axial speed, and axial acceleration of the drillstring may be oscillated over time about corresponding predetermined set points and between corresponding maximum and minimum and maximum values.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A method for drilling a borehole in an earthen formation, comprising:

(a) providing a drilling system including a drillstring having a longitudinal axis, a bottom-hole assembly coupled to a lower end of the drillstring, and a drill bit coupled to a lower end of the bottom-hole assembly;

(b) rotating the drill bit at a rotational speed;

(c) applying weight-on-bit to the drill bit and advancing the drill bit through the formation to form the borehole;

(d) pumping a drilling fluid down the drillstring to the drill bit, wherein the drilling fluid has a flow rate down the drillstring;

(e) selecting a predetermined rotational speed set point value for the drill bit;

(f) selecting a predetermined maximum rotational speed that is greater than the set point value and a predetermined minimum rotational speed that is less than the set point value;

(g) oscillating the rotational speed of the drill bit asymmetrically and non-uniformly about the set point value during (c), wherein the oscillations of the rotational speed of the drill bit have a random period or a random amplitude between the predetermined maximum rotational speed and the predetermined minimum rotational speed;

(h) maintaining the rotational speed of the drill bit between the predetermined maximum rotational speed and the predetermined minimum rotational speed during (g); and (i) generating non-steady state conditions in the borehole during (g).

2. The method of claim 1, wherein the oscillations of the rotational speed of the drill bit have a period that is less than 10 seconds.

3. The method of claim 1, wherein the predetermined rotational speed set point value varies with time.

4. The method of claim 1, further comprising:

(j) oscillating an axial speed or an axial acceleration of the drill bit during (c).

5. The method of claim 4, wherein the axial speed of the drill bit is oscillated about a predetermined axial speed set point value, and wherein the axial speed of the drill bit is maintained between a predetermined maximum axial speed and a predetermined minimum axial speed.

6. The method of claim 5, further comprising:

(h) oscillating the flow rate of the drilling fluid down the drillstring during (c).

7. The method of claim 6, wherein the oscillations of the rotational speed of the drill bit, the axial speed of the drill bit, and the flow rate of the drilling fluid each have a period that is less than 10 seconds.

8. The method of claim 7, wherein the oscillations of the rotational speed of the drill bit, the axial speed of the drill bit, and the flow rate of the drilling fluid each have a random period less than 10 seconds or a random amplitude between the predetermined maximum axial speed and the predetermined minimum axial speed.

9. The method of claim 4, wherein the rotation of the drill bit inputs a first amount of energy into the drilling system, the axial movement of the drill bit inputs a second amount of energy into the drilling system, and the flow of drilling fluid inputs a third amount of energy into the drilling system; and wherein (i) comprises oscillating the sum of the first amount of energy, the second amount of energy, and the third amount of energy.

10. A method for maintaining non-steady state conditions in a borehole being drilled in an earthen formation, comprising:

(a) providing a drilling system including a drillstring having a longitudinal axis, a bottom-hole assembly coupled to a lower end of the drillstring, and a drill bit coupled to a lower end of the bottom-hole assembly;

(b) applying torque to the drill bit to rotate the drill bit, wherein the drill bit has a rotational speed and a rotational acceleration;

(c) applying weight-on-bit to the drill bit to advance the drill bit through the formation to form the borehole, wherein the drill bit has an axial speed and an axial acceleration;

(d) pumping a drilling fluid down the drillstring to the drill bit, wherein the drilling fluid has a flow rate down the drillstring and a pressure at an inlet of the drillstring;

(e) selecting a first set point value for the rotational speed of the drill bit, a second set point value for the axial speed of the drill bit, and a third set point value for the flow rate of the drilling fluid down the drillstring;

(f) controllably oscillating rotational speed of the drill bit, the axial speed of the drill bit, and the flow rate of the drilling fluid down the drillstring about the first set point value, the second set point value, and the third set point value, respectively, during (c)

wherein the oscillations in (f) of the rotational speed of the drill bit, the axial speed of the drill bit, and the flow rate of the drilling fluid down the drillstring each have a random period less than 10 seconds and wherein the rotational speed of the drill bit, the axial speed of the drill bit, and the flow rate of the drilling fluid down the drillstring are each randomly oscillated in (f) between a predetermined maximum value and a predetermined minimum value.

11. The method of claim 10, wherein the oscillations in (f) of the rotational speed of the drill bit, the axial speed of the drill bit, and the flow rate of the drilling fluid down the drillstring each have a period less than 5 seconds.

12. A computer-readable storage medium comprising software that, when executed by a processor, causes the processor to:

(a) receive a predetermined maximum rotational speed for a drill bit, a predetermined minimum rotational speed for the drill bit, and a predetermined set point value for the rotational speed of the drill bit;

(b) monitor the rotational speed of the drill bit;

(c) control the rotational speed of the drill bit; and (d) oscillate the rotational speed of the drill bit asymmetrically and non-uniformly about the predetermined set point value, the oscillations of the rotational speed of the drill bit having a random period or a random amplitude between the predetermined maximum rotational speed and the predetermined minimum rotational speed.

13. The computer-readable storage medium of claim 12, wherein the software further causes the software to:

(e) receive a predetermined maximum axial speed for the drill bit, a predetermined minimum axial speed for the drill bit, and a predetermined set point value for the axial speed of the drill bit;

(f) monitor the axial speed of the drill bit;

(g) control the axial speed of the drill bit; and (h) oscillate the axial speed of the drill bit between the predetermined maximum axial speed and the predetermined minimum axial speed generally about the predetermined set point value for the axial speed.

14. The computer-readable storage medium of claim 13, wherein the software further causes the software to:

(e) receive a predetermined maximum flow rate for a drilling fluid, a predetermined minimum flow rate for the drilling fluid, and a predetermined set point value for the flow rate of the drilling fluid;

(f) monitor the flow rate of the drilling fluid;

(g) control the flow rate of the drilling fluid; and (h) oscillate the flow rate of the drilling fluid between the predetermined maximum flow rate and the predetermined minimum flow rate generally about the predetermined set point value for the flow rate.

15. The computer-readable storage medium of claim 14, wherein the software further causes the software to:

monitor a plurality of downhole conditions in a borehole during a drilling process;

oscillate the rotational speed of the drill bit, the axial speed of the drill bit, and the flow rate of the drilling fluid in response to the down-hole conditions in the borehole.

* * * * *